US005930956A

United States Patent [19]

Trosper et al.

[11] Patent Number: 5,930,956

[45] **Date of Patent: *Aug. 3, 1999**

[54] DROPCLOTH

[75] Inventors: Stephen Trosper; Frederick Taylor, both of Gainesville, Fla.

[73] Assignee: Stephen Trosper, Las Vegas, Nev.

[ * ] Notice: This patent is subject to a terminal disclaimer.

[21] Appl. No.: 08/941,161

[22] Filed: Sep. 30, 1997

Related U.S. Application Data

[63] Continuation-in-part of application No. 08/552,317, Nov. 2, 1995, Pat. No. 5,761,853.

[51] Int. Cl.[6] ..... B05C 11/11; E04H 15/30; E04H 15/18; B65D 65/02

[52] U.S. Cl. ..... 52/3; 118/504; 150/154; 135/95; 135/97

[58] Field of Search ..... 52/3; 118/504; 135/97, 95, 115, 900, 901, 902; 150/154

[56] References Cited

U.S. PATENT DOCUMENTS

| | | | |
|---|---|---|---|
| 3,537,688 | 11/1970 | Stein . | |
| 3,862,876 | 1/1975 | Graves . | |
| 3,872,549 | 3/1975 | Elyea . | |
| 4,031,589 | 6/1977 | Couch . | |
| 4,194,678 | 3/1980 | Jasper . | |
| 4,606,070 | 8/1986 | Schachter . | |
| 4,632,138 | 12/1986 | Irwin . | |
| 4,682,447 | 7/1987 | Osborn . | |
| 5,275,460 | 1/1994 | Kraus | 296/136 |
| 5,477,965 | 12/1995 | Herbeck | 206/424 |
| 5,638,642 | 6/1997 | Nemec | 52/3 |
| 5,638,850 | 6/1997 | Hazinski et al. | 135/120.12 |
| 5,706,618 | 1/1998 | Pratt | 52/199 |
| 5,761,853 | 6/1998 | Trosper et al. | 52/3 |
| 5,791,363 | 8/1998 | Moses | 135/143 |

*Primary Examiner*—James Derrington
*Assistant Examiner*—Jacqueline A. Ruller
*Attorney, Agent, or Firm*—Saliwanchik, LLoyd & Saliwanchik

[57] ABSTRACT

An easily and quickly deployable device for protecting against soiling of non-workpiece items during painting of a workpiece is provided by a device having at least one rigid section and at least one flexible section. The rigid section also acts as a central area for the flexible section. The device is folded open to protect non-workpiece items during the painting operation.

20 Claims, 5 Drawing Sheets

DROPCLOTH

CROSS-REFERENCE TO A RELATED APPLICATION

This is a continuation-in-part of co-pending application Ser. No. 08/552,317, filed Nov. 2, 1995 now U.S. Pat. No. 5,761,853, Jun. 9, 1998.

BACKGROUND OF THE INVENTION i. Field of the Invention

This invention relates to an easily and quickly deployable covering, or dropcloth, for use by painters to protect non-workpiece items against paint splatter while painting a workpiece.

ii. Background

Most aspects of paint technology have received considerable attention in the past, such that improved paint rollers, brushes, spray guns and other painting accessories are commercially available. However, in terms of protecting non-workpiece items against paint splatter, the state of technology has remained largely unchanged, with the standard solution being to drape a cloth, plastic, canvas or other type of sheet, such as the tarpaulin of U.S. Pat. No. 4,682,447, over non-workpiece items, particularly the floor. Unfortunately, this solution is not ideal as it is time consuming to spread these types of protective sheets, and frequently soiling of the floor occurs anyway as the soiled protective sheet folds over, or otherwise comes in contact with the floor. Items such as the portable drip collector of U.S. Pat. No. 4,031,589, and the drop cloth holder of U.S. Pat. No. 3,872,549, do not fully address the problems of paint splatter and only underscore the need for a more perfect solution.

What is needed, therefore, is an easily and quickly deployable and easily moved covering which overcomes these problems. This invention provides such a solution.

BRIEF SUMMARY OF THE INVENTION

An easily and quickly deployable dropcloth, for use in protection against soiling of non-workpiece items such as the floor during painting of a workpiece such as the wall, is provided by a device having rigid panels which slide into pockets formed in a protective fabric. The rigid panels within the fabric form a rigid central base area. Attached thereto are outwardly spreadable, pre-sewn protective flaps which extend from the central base area to selectively extend the coverage area. The flaps of the device also fold inwardly after use for easy moving or clean-up. After folding the soiled protective sheeting or flaps onto the wet surface of the rigid base area, the panels may then be folded toward each other to provide a dropcloth that is easy to transport and which eliminates contact by soiled portions of the device with the floor or other non-workpiece items. Preferably, in the flaps which fold out, there are pre-sewn channels for insertion of rigid dowels to increase the maneuverability of the spread-out dropcloth.

In a preferred embodiment, the dropcloth is designed to prevent soiling or splatter by paint of a non-workpiece item (e.g., flooring) during the painting of a workpiece (e.g., wall). The dropcloth is made up of a protective fabric having a working surface and an underside, the protective fabric defining a fixed area of coverage to cover a proportionate area of the non-workpiece item. The dropcloth also has at least one flat rigid panel to which the protective fabric is affixed, either by containing the rigid panel within a pocket formed from the protective fabric or by the rigid panel being affixed to the underside of the protective fabric, and wherein the area of the flat rigid panel substantially matches the fixed area of coverage of the protective fabric to which it is affixed; and the dropcloth has at least one flexible section of the protective fabric extending from at least one side of the fixed area of coverage to selectively increase the fixed area of coverage in an amount less than or equal to the area of the flexible section; so that the amount of protection provided by the protective fabric can be selectively increased from the fixed area of coverage up to the fixed area of coverage plus the area of the flexible section. In a more preferred embodiment, the dropcloth has two flat rigid panels, the combined area of which together substantially match the fixed area of coverage of the protective fabric and allow the protective fabric to be folded substantially in half with the rigid panels affixed. The dropcloth also preferably has two flexible sections extending from opposite sides of the fixed area of coverage. An outer aspect of the flexible section may be affixed to a rigid rod. The protective fabric may be of cloth, plastic, any material with a liquid impermeable backing or woven tarpaulin material. The rigid panel may be of cardboard, wood, plastic or metal. In one embodiment, the rigid panel member is made of sections of bonded cardboard, each section having corrugations perpendicularly offset from the section to which it is bonded. The rigid member can have two halves which may be assembled or disassembled and the two halves of the rigid member can be assembled and disassembled by means of interlocking tongue and groove edges.

In an alternate embodiment, the flexible sections and the rigid sections can be easily separated and re-attached to each other by, for example, hook-and-loop material, zipper or snaps. The protective sheet may also be disposable and include a handle for easily transporting the device in a fully folded state.

In an alternate embodiment, the dropcloth for protecting flooring and horizontal surfaces while preparing and painting walls and vertical surfaces includes a substantially rectangular shaped flexible protective fabric having plurality linearly spaced sections; at least one substantially flat rigid panel member affixed to one of the sections such that the entire section becomes substantially flat and rigid; and at least one section remaining flexible, whereby the area of coverage provided by the protective fabric may be selectively increased from the area equal to the panel up to the combined area of the panel and the flexible section. The protective fabric preferably has four linearly spaced sections such that two flat rigid panel members are affixed to the inner sections and the outer sections remain flexible. The dropcloth may also include two elongated members such as dowels affixed to the outer edge of each of the outer sections such that the outer sections may be easily folded over the inner sections for minimal coverage or extended the length of the outer sections for maximum coverage or positioned therebetween for selective coverage. Alternatively, two additional flat rigid panel members having an area less than the area of the outer sections may replace the dowels. These flat rigid members are preferably affixed toward the outer edge of each outer section such that the outer sections may be easily folded over the inner sections for minimal coverage or extended the length of the outer sections for maximum coverage or positioned therebetween for selective coverage. The flat rigid panel member may be affixed by insertion into a pocket of the section or attached to an underside of the section.

Accordingly, it is one object of this invention to provide an improved dropcloth for preventing paint splatter on non-workpiece items.

Another object of this invention is to provide a novel dropcloth which is quickly and easily deployed and moved during the painting process.

Another object of this invention is to provide a dropcloth having rigid panels within a protective fabric, fabric flaps which fold outwardly from the rigid panel area, such that upon completion of a painting operation, the device can be folded onto itself, wet surface to wet surface, and thereafter be easily moved without the danger of soiling non-workpiece items.

Other objects and advantages of the invention will become readily apparent from a review of the complete disclosure.

DETAILED DESCRIPTION OF THE INVENTION

This invention provides a novel device useful to those wishing to paint a workpiece without splashing or otherwise soiling non-workpiece items such as the floor. In the trade, this type of dropcloth is often referred to as a runner. The device comprises at least one rigid central section, and at least one flexible flap extending therefrom. Preferably, the dropcloth comprises a rectangular shaped flexible protective fabric having a number of linearly spaced sections. Preferably, the device comprises two internal rigid quadrants (sections), two flexible flaps (sections) extending therefrom, the external aspect of each of these flaps housing a rigid rod or like member. What follows is a detailed description of methods of making and using this device, including its best mode.

Figure 1A:
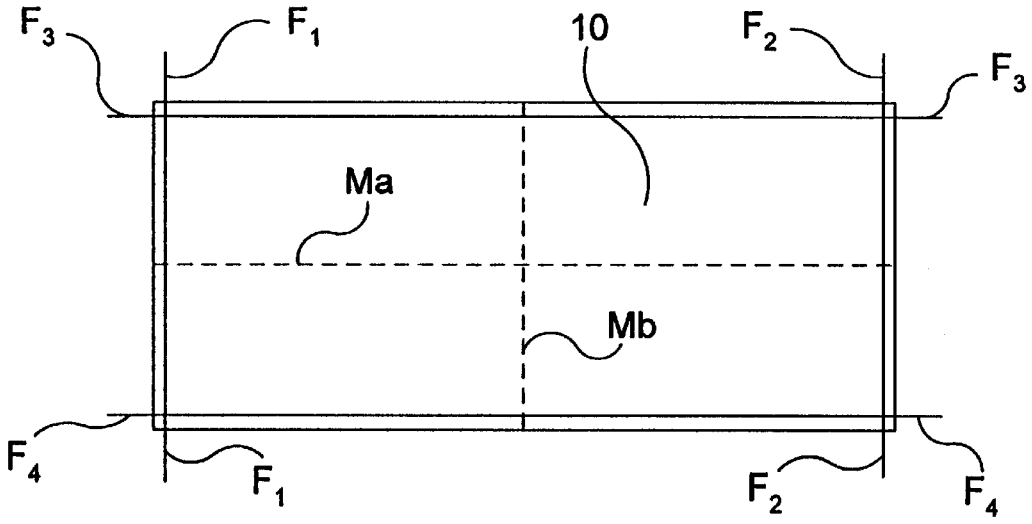
FIG. 1A shows a plan view of a piece of fabric with fold lines for preparation of the dropcloth of the present invention.

With reference to FIG. 1A, one method of making the device of this invention is disclosed. A piece of fabric 10 is cut to any desired dimensions. The term "fabric" should be understood to mean any type of cloth, plastic, fabric or like material which can be easily spread over the floor or a workpiece. Preferred materials for this purpose include plastic sheeting, canvas, woven tarpaulin material and the like. A commercially available material that is preferred is known as POLYDUCK (available from Reeves & Co., Durham, N.C.), which is a cotton or similar fabric with a liquid impermeable back coating.

For the purposes of the following description, preferred dimensions for the fabric 10 are provided, but it will be immediately recognized that the principles of this invention may be applied to any given dimensions. The dimensions provided are therefore only exemplary, but are preferred for preparation of a dropcloth runner which is easily deployed for use in painting walls in residential or other buildings, (dimensions for a smaller version of the dropcloth, which is adapted for use in closets and other confined spaces, are provided below). Accordingly, the fabric 10 of this example is rectangular in shape and has dimensions of 146 inches (12 ft., 2 in.), in length, and 75 inches (6 ft., 3 in.) in width. Markings F1, F2, F3, and F4 indicate the points of making the first through fourth folds in the fabric, respectively. The marking Ma indicates the midpoint in the width dimension, and the marking Mb indicates the midpoint in the length dimension. Folds F1, F2, F3, and F4 preferably each use about 1.5 inches of material, and the flap created by folding over the material is sewn or otherwise affixed along the folded-over edge. The new dimensions of the cloth with edges sewn, as shown in FIG. 1B, would be 143 inches (11 ft., 11 in.) in length, and 72 inches (6 ft.) in width.

Figure 1B:
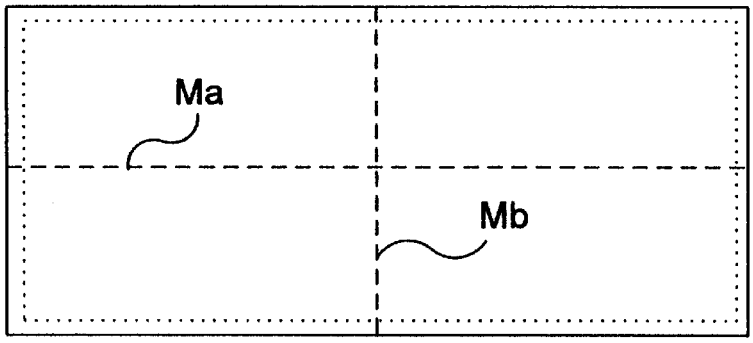
FIG. 1B shows a plan view of the same piece of fabric after the edges have been folded and sewn or otherwise fixed in place.
Figure 1C:
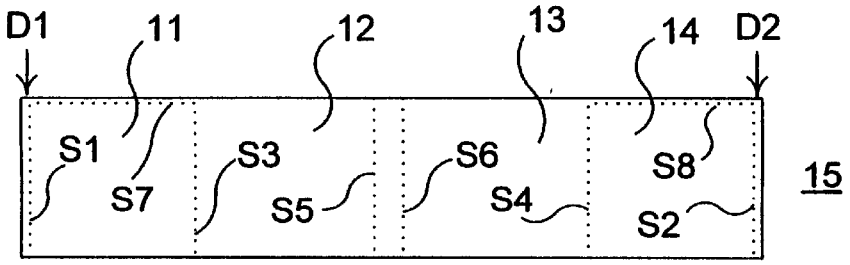
FIG. 1C shows a plan view of the same piece of fabric after pockets have been made by folding the fabric along its midline and affixing appropriate seams.
Figure 1D:
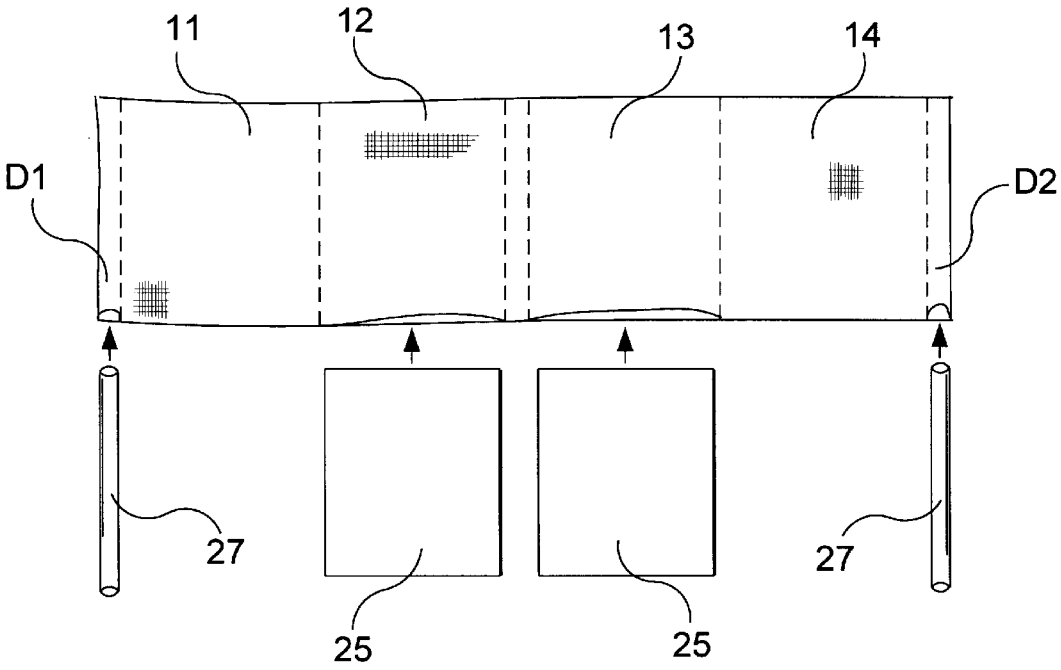
FIG. 1D shows a partially disassembled plan view of the dropcloth with the dowels and rigid panel members prior to insertion into the pockets. 25

In FIG. 1C, the cloth of FIG. 1B has been folded over upon itself along the midpoint line Ma. Seams are now sewn or otherwise affixed (using hook and loop material, zippers, snaps or the like) in the material as follows: S1 and S2 are sewn or otherwise affixed vertically, about 1–2 inches in from either end. Horizontal seams S7 and S8 are sewn inward from seams S1 and S2, to a point about 36 inches in from each edge. At that same point, about 36 inches in from each edge, vertical seams S3 and S4 are sewn or otherwise affixed. Finally, seams S5 and S6 are sewn vertically, about 1 inch from each other, on either side of the midpoint line Mb. As a result of the foregoing operations, a segmented cloth having the following quadrants is created, with dimensions as follows: Quadrants 11 and 14, 36 in.×35 in.; quadrants 12 and 13, 36 in.×36 in. Quadrants 12 and 13 form pockets or slots into which flat, rigid panel members 25, described below and shown in FIG. 1D, are inserted. Slots D1 and D2 have also been created with open ends for insertion of dowels 27. The dowels 27 are preferably constructed of an inexpensive, light-weight but strong and rigid material. Wooden dowels, having a diameter of about 0.25 inches and a length of about 36 inches have been found adequate for this purpose. When inserted, the dowels are completely covered with no part extending out from the protective fabric to prevent soiling the dowels. Naturally, other materials such as plastic rods, fiberglass, aluminum or like materials could be used for this purpose, and the diameter of the rod may be adjusted accordingly, depending on the strength and rigidity of the material used. With the seams sewn as described above, and the rods or dowels 27 inserted into slots D1 and D2 as described, the partially assembled dropcloth 15 of this invention is prepared. When assembled, quadrants 12 and 13 become rigid with the insertion of rigid panel members 25. Quadrants 11 and 14 remain flexible except for the outer edges which become rigid with the insertion of the dowels. With the dowels 27 in place, quadrants 11 and 14 may be folded over quadrants 12 and 13, respectively, for minimum coverage or extended fully for maximum coverage or placed anywhere therebetween for selective coverage.

Figure 1E:
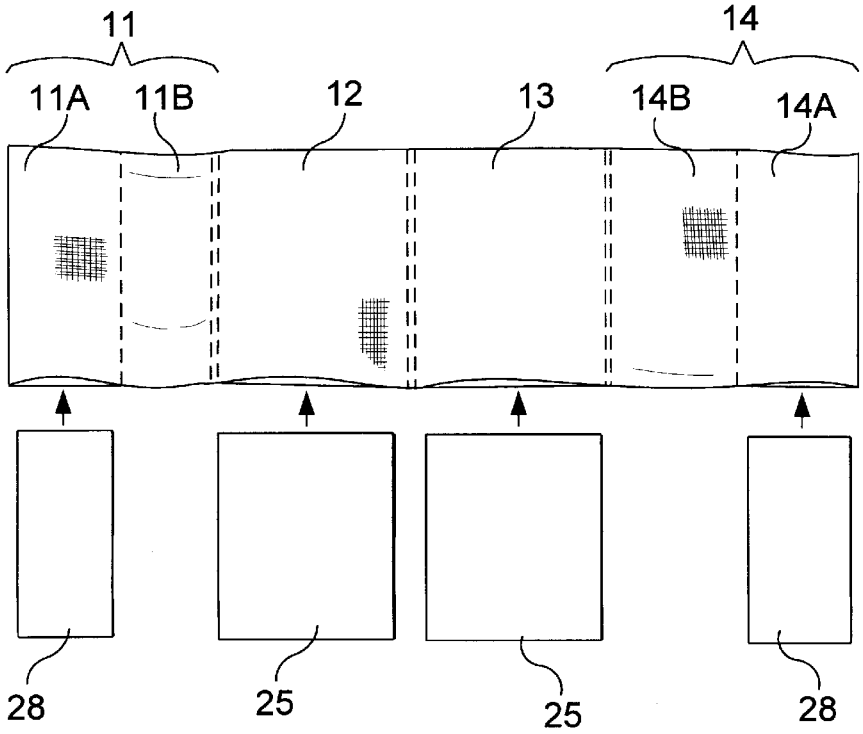
FIG. 1E shows a partially disassembled plan view of the dropcloth with the various sized rigid panel members prior to insertion into the pockets.

In an alternate embodiment, shown in FIG. 1E, the dowels 27 are replaced with flat rigid panel members 28 which are smaller than the outer quadrants 11, 14 (e.g., same width but half the length, e.g., 36×18 in.). These smaller panel members 28 would be placed toward the outer edge 11*a*, 14*a* of each outer quadrant 11, 14, thereby leaving a section of flexible material 11*b*, 14*b* between the outer edge 11*a*, 14*a* and the central area formed by the rigid panel members of the inner quadrants 12, 13. The sections of flexible material 11*b*, 14*b* allow the total length of the dropcloth to be adjusted. That is, quadrants 11 and 14 may be folded over quadrants 12 and 13, respectively, for minimal coverage or extended completely for maximum coverage or placed anywhere therebetween for selective coverage.

While the foregoing description provides one method, using a single starting piece of fabric, for making the partially assembled dropcloth 15 of this invention, it would be obvious to those skilled in the art, based on the foregoing disclosure, that a similar result could be achieved using obvious modifications on this method. Thus, the pocket quadrants 12 and 13 could be independently assembled and then attached to each other. Side flaps (quadrants 11 and 14) could likewise be independently prepared and then attached to the pocket quadrants, 12 and 13. In addition, obviously the pockets of quadrants 12 and 13 could be eliminated completely, and the rigid panel member described below could be simply affixed to the underside of fabric of appropriate dimensions. Thus, these alternate methods of making the invention come within the scope of the instant invention. In another preferred embodiment of this invention, additional flexibility of the dropcloth is achieved if the quadrants are easily detached and reattached from and to each other. This is easily achieved by, for example, providing matching hook and loop material strips, zippers, snaps, or the like along the edges of each quadrant. It should also be noted that to prevent soiling of the dropcloth, such secondary items as a protective paper or plastic sheet with the appropriate dimensions could be easily attached to the surface of the dropcloth prior to each painting operation and then disposed. This, however, is not required for operation of the dropcloth for, even when the paint dries in the folded state of the dropcloth, the quadrants can be quite easily pealed apart.

Figure 2A:
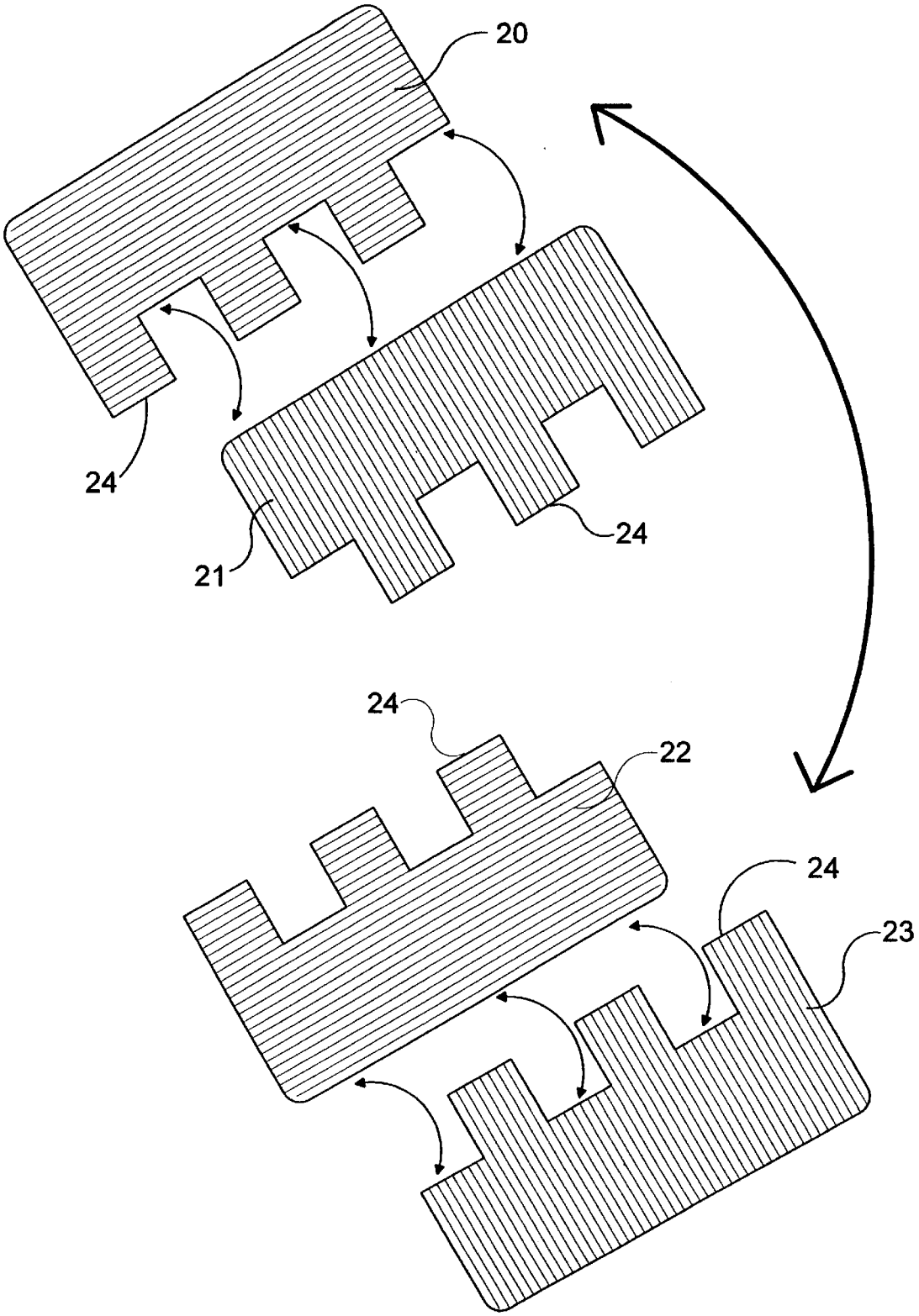
FIG. 2A shows one embodiment of the rigid panels, in a disassembled state, ready for shipment and assembly for insertion into the pockets of the dropcloth.
Figure 2B:
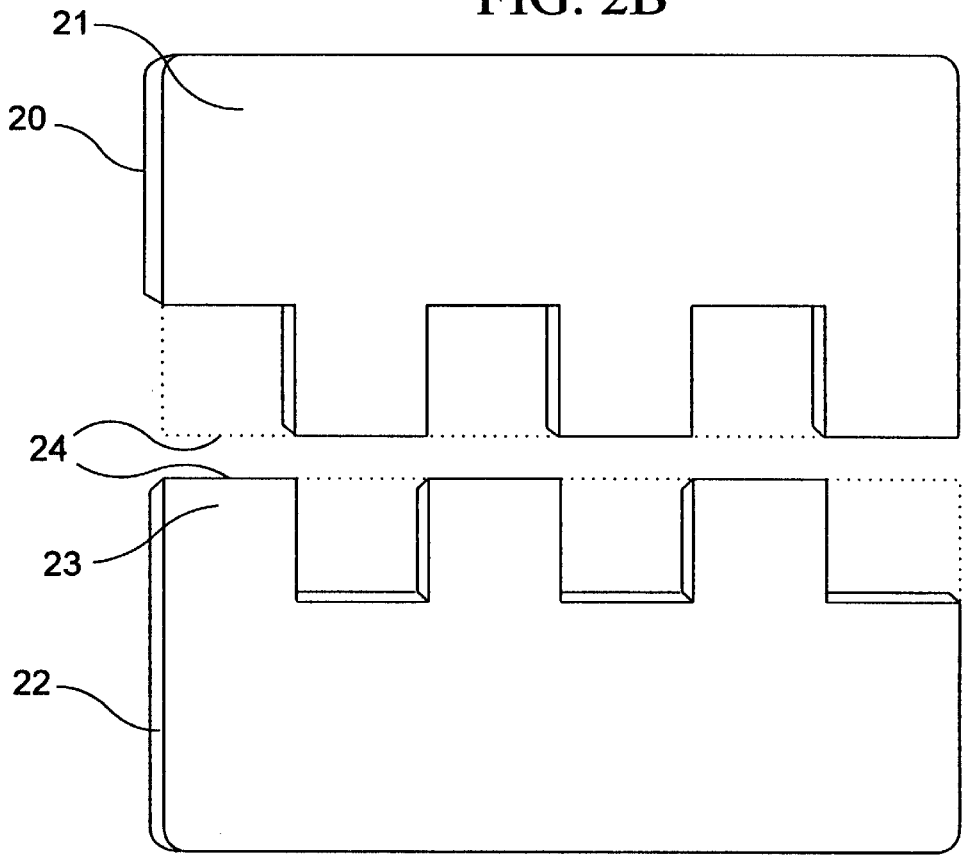
FIG. 2B shows the rigid panels in the next stage of assembly, ready for final assembly and insertion into the pockets of the dropcloth.
Figure 2C:
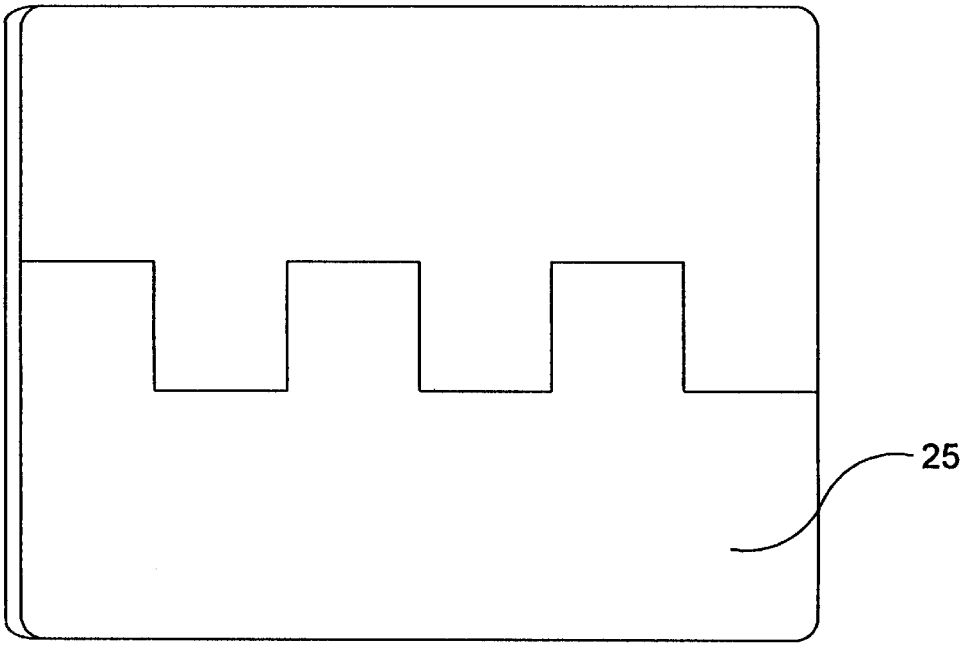
FIG. 2C shows the assembled rigid panels, ready for insertion into the pockets of the dropcloth.

Referring now to FIG. 2A the rigid panel members for insertion into the pockets will be described. There is provided four sub-sections 20, 21, 22, 23 of a flat rigid panel material, each cut in such a way as to have a serrated or toothed edge 24. Each tooth or serration preferably is about 6 inches across. Each subsection preferably has dimensions of about 21 inches (1 ft. 9 in.) by 36 inches (3 ft.). For cost purposes, this material is preferably a rigid cardboard, with the corrugations of sections 20 and 21, and those of sections 22 and 23 preferably being perpendicular to each other, thereby forming a web-like pattern in the corrugations when subsections 20 and 21 are bonded to each other, and subsections 22 and 23 are bonded to each other. The thus bonded subsections provide increased rigidity. In this fashion, sections 20 and 21 may be affixed to each other, and sections 22 and 23 may be affixed or bonded to each other, by gluing, stapling, riveting or like methods known in the art. As a result, two sections, one made of subsections 20 and 21 and the other made of subsections 22 and 23 are prepared, as shown in FIG. 2B. The teeth or serrations 24 of these sections may now be brought together in a tongue and groove format to form the interlocked, assembled rigid member 25 shown in FIG. 2C. The rigid panel member 25 preferably is square and has dimensions of about 36 inches by 36 inches (3 ft.×3 ft.). A rigid panel member 25 prepared as described above, may be inserted into each of the pockets 12 and 13 of the partially assembled dropcloth 15 to make the fully assembled dropcloth 30 of this invention, shown in FIG. 3. The easy removal of the rigid sections is desirable as this allows washing of the fabric portion of the dropcloth.

It should be noted that the foregoing description of the rigid panel member 25 is one preferred embodiment from the perspective of reduced cost, ease of manufacture, and ease of shipment. However, any flat rigid panel member of the necessary dimensions for insertion into the pockets 12 and 13 could be used, without any need for assembly. Thus, simple square cardboard sections of dimension about 36 inches by 36 inches could be used. Alternatively, rigid aluminum or other metal, wood, plastic, fiberglass, plexiglass or like synthetic materials of the appropriate dimensions could be used. These could be used either as single sections or as subsections which could be assembled in a fashion similar to that described above for the cardboard subsections.

Figure 3A:
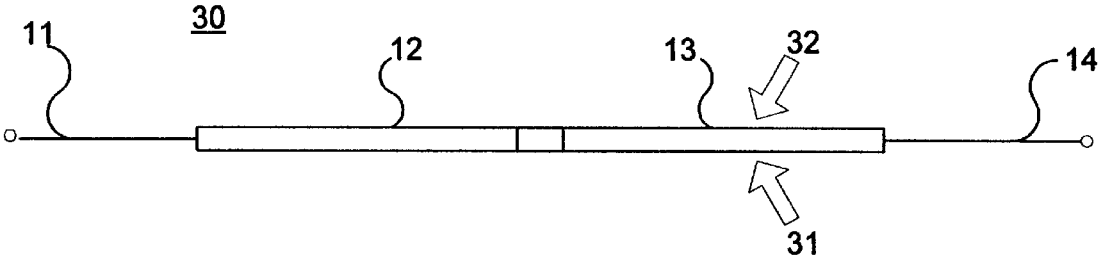
FIG. 3A–E shows a side view of the device as deployed and the method of folding for stowage.
Figure 3B:
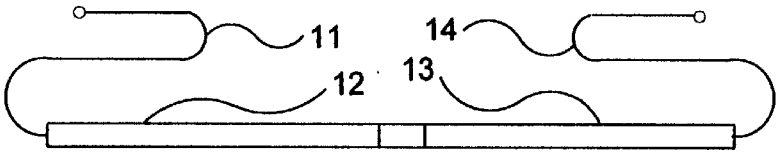
Figure 3C:
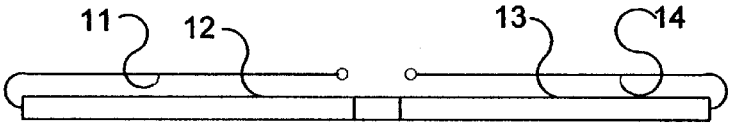
Figure 3D:
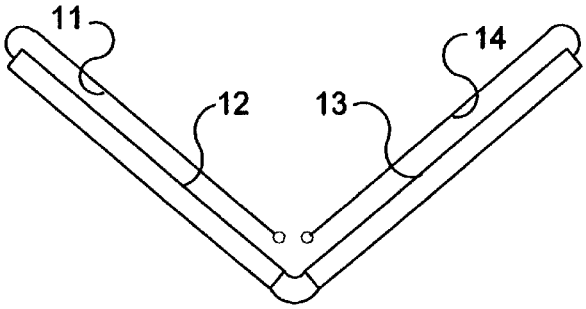
Figure 3E:
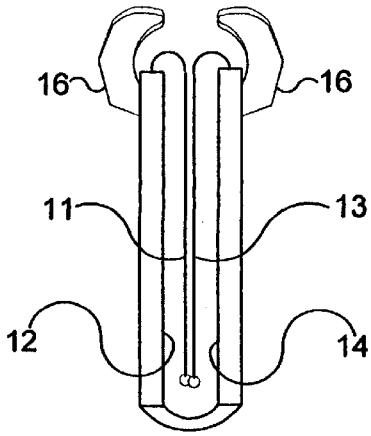

Referring now to FIG. 3A, the fully assembled and deployed dropeloth 30 is shown in its most extended form. The dry 31 and wet 32 surfaces are emphasized. In FIG. 3B, a reduced amount of extension of the flexible quadrants 11 and 14 is shown. The continued contact of only wet to wet surfaces is evident. It can be seen that by proper folding of the quadrants 11 and 14, from 143 inches down to about 73 inches of coverage can be provided. In addition, if quadrant 12 is first folded onto quadrant 13, and each of quadrants 11 and 14 are only folded out to the extent needed to protect the dryness of the folded rigid quadrants, a coverage of about 36 inches can be achieved. Referring to FIG. 3C, the quadrants 11 and 14 are shown folded onto quadrants 11 and 12, with only wet surfaces making contact with each other. In FIG. 3D, it can be seen how the two halves of the dropcloth are folded toward each other. In FIG. 3E, the fully closed dropcloth is shown. In this state, the device is easily movable or transportable. To assist in easy transport, in a preferred embodiment, there is optionally provided a handle, 16, made of cloth, plastic, leather or any other suitable material, on the underside of each half of the folded dropcloth.

The foregoing description provides details on the preparation and use of a large dropcloth device. In similar fashion, a smaller embodiment of the dropcloth, can be made with the following dimensions:

Dropcloth: 79 inches (6 ft. 7 in.) long×20 inches (1 ft. 8 in.) wide, (starting from a single piece of fabric of about 82 inches×43 inches).

Rigid panels: 20 inches×20 inches (square).

Dowels: 20 inches×¼ inch in diameter.

The exemplary dimensions given above for the dropcloth are preferred because the average splatter zone during a painting operation is about 32 inches out from a wall. Over 95% of paint specs fall within this zone. Thus, with dimensions of 36 inches, up to about 99% coverage is provided. A length of about 11 ft., 11 inches is preferred for the dropcloth because the average bedroom is about 12 ft.×12 ft., thus allowing coverage of an entire wall without the need to move or adjust the dropcloth. In addition, if the wall is longer, the paint source would need to be moved in any event. At the same time, the dropcloth could be easily moved and replaced. The preferred smaller dropcloth dimensions for closets are chosen so as to maximize protective coverage, while at the same time enhancing the maneuverability of the dropcloth.

The collapsibility of the panels of the dropcloth serves as a convenient method for packaging and storing the dropcloth. By allowing the painter to remove panels and then separate panels, the size can be reduced from 36 inches×36 inches to 21 inches×36 inches (about a 42% reduction in size).

Use of dowels in the fold-out flaps allows for full control of the flexible flaps, even with one hand. In addition, upon folding the flaps inwardly for storage or movement from one location to another, the weight and rigidity of the dowels assist in forcing the flaps to fall evenly to the center of the dropcloth. This also forces the wet sides of the dropcloth to contact each other, preventing soiling of dry surfaces of the dropcloth and of non-workpiece items.

The rigidity of the dropcloth is one of the key aspects to the improved utility of this device over those previously used in the art. Flexible dropcloths of the prior art (like an old sheet or plastic sheeting) must be placed carefully against the walls by hand. Without any rigid support as in the present invention, plastic sheeting will fold, crease and wrinkle if one tries to push it when moving it. On the other hand, by having central panel(s) which are rigid as in the present invention, folding, creasing and wrinkling of the cloth over onto itself and onto the floor or other non-workpiece items is prevented. Painters can merely push quadrants 12 or 13 of the dropcloth to move its position and then reposition quadrants 11 and 14 as needed. Laymen and experienced painters alike will find this device to be a great time and labor saver as the need to clean paint smears from carpeting, the floor or other non-workpiece items will be eliminated. In addition, the rigidity of the dropcloth allows easy placement and replacement, even with a single hand, during the painting operation. In addition, the flexible flaps or quadrants of the dropcloth allow for full selective adjustability of the protective surface from about 36 inches to about 143 inches, depending on how far the flaps are folded out.

While the foregoing description has provided specific details about the methods of making and using the dropcloth of the instant invention, including its best mode, those skilled in the art will recognize that alterations and modifications thereof come within the scope of the invention as claimed herein below.

References

Osborn, Paul V., U.S. Pat. No. 4,682,447, issued Jul. 28, 1987.

Couch, Robert L., U.S. Pat. No. 4, 031,589, issued Jun. 28, 1977.

Elyea, Charles M., U.S. Pat. No. 3,872,549, issued Mar. 25, 1975.

We claim:

1. A device to prevent soiling or splatter by paint of a non-workpiece item during the painting of a workpiece which comprises:

(a) a protective fabric having a working surface and an underside, said protective fabric defining a fixed area of coverage to cover a proportionate area of said non-workpiece item;

(b) at least one flat rigid panel to which said protective fabric is affixed, either by containing said rigid panel within a pocket formed from said protective fabric or by said rigid panel being affixed to the underside of said protective fabric, and wherein the area of said flat rigid panel substantially matches the fixed area of coverage of the protective fabric to which it is affixed; and (c) at least one flexible section of said protective fabric extending from at least one side of said fixed area of coverage to selectively increase said fixed area of coverage in an amount less than or equal to the area of said flexible section; whereby the amount of protection provided by said protective fabric can be selectively increased from said fixed area of coverage up to said fixed area of coverage plus the area of said flexible section.

2. The device of claim 1 comprising two flat rigid panels, the combined area of which together substantially match the fixed area of coverage of the protective fabric and allow said protective fabric to be folded substantially in half with said rigid panels affixed.

3. The device of claim 2 comprising two flexible sections extending from opposite sides of said fixed area of coverage.

4. The device of claim 1 wherein an outer aspect of said flexible section is affixed to a rigid rod.

5. The device of claim 1 wherein said protective fabric comprises cloth, plastic, material with a liquid impermeable backing or woven tarpaulin material.

6. The device of claim 1 where in said rigid panel comprises cardboard, wood, plastic or metal.

7. The device of claim 6 in which the rigid member comprises sections of bonded cardboard, each section having corrugations perpendicularly offset from the section to which it is bonded.

8. The device of claim 7 in which the rigid member has two halves which may be assembled or disassembled.

9. The device of claim 8 in which the two halves of said rigid member can be assembled and disassembled by means of interlocking tongue and groove edges.

10. A device to prevent soiling or splatter of a non-workpiece item during the painting of a workpiece comprising:

(a) a protective fabric having a working surface and an underside, said protective fabric defining a fixed area of coverage to cover a proportionate area of said non-workpiece item;

(b) two flat rigid panels to which said protective fabric is affixed, either by containing said rigid panel within a pocket formed from said protective fabric or by said rigid panel being affixed to the underside of said protective fabric, thereby forming two rigid sections which are hingedly connected to each other by a flexible portion of said protective fabric, wherein the area of said flat rigid panels combined substantially matches the fixed area of coverage of the protective fabric; and (c) two flexible sections of said protective fabric extending from opposite sides of said fixed area of coverage and which can be folded out from and into the center of said rigid sections whereby the amount of protection provided by said protective fabric can be selectively increased from said fixed area of coverage up to said fixed area of coverage plus the area of said flexible section.

11. The device of claim 10 wherein each said flexible section has a rigid rod affixed to its outermost aspect.

12. The device of claim 10 wherein said flexible sections and said rigid sections can be easily separated and re-attached to each other.

13. The device of claim 12 in which said separation and said re-attachment is by means of hook-and-loop material, zipper or snaps.

14. The device of claim 10 further comprising a disposable protective sheet for use in preventing soiling of the device.

15. The device of claim 10 further comprising a handle for easily transporting the device in a fully folded state.

16. A dropcloth for protecting flooring and horizontal surfaces while preparing and painting walls and vertical surfaces comprising:

(a) a substantially rectangular shaped flexible protective fabric having plurality linearly spaced sections;

(b) at least one substantially flat rigid panel member affixed to one of said sections such that said entire section becomes substantially flat and rigid; and (C) at least one section remaining flexible, whereby the area of coverage provided by said protective fabric may be selectively increased from the area equal to said panel up to the combined area of said panel and said flexible section.

17. The dropcloth of claim 16 wherein said protective fabric has four linearly spaced sections such that two flat rigid panel members are affixed to the inner sections and the outer sections remain flexible.

18. The dropcloth of claim 17 wherein further comprising two elongated members affixed to the outer edge of each of the outer sections such that the outer sections may be easily folded over said inner sections for minimal coverage or extended the length of the outer sections for maximum coverage or positioned therebetween for selective coverage.

19. The dropcloth of claim 17 further comprising two additional flat rigid panel members having an area less than the area of said outer sections affixed toward the outer edge of each outer section such that the outer sections may be easily folded over said inner sections for minimal coverage or extended the length of the outer sections for maximum coverage or positioned therebetween for selective coverage.

20. The dropcloth of claim 16 wherein said flat rigid panel member is affixed by insertion into a pocket of said section or attached to an underside of said section.

* * * * *